US006176389B1

(12) United States Patent
de Laforcade

(10) Patent No.: US 6,176,389 B1
(45) Date of Patent: Jan. 23, 2001

(54) CONTAINER, SYSTEM, AND METHOD FOR DISPENSING FLUID

(75) Inventor: Vincent de Laforcade, Rambouillet (FR)

(73) Assignee: L'Oréal S.A., Paris (FR)

( * ) Notice: Under 35 U.S.C. 154(b), the term of this patent shall be extended for 0 days.

(21) Appl. No.: 09/215,290

(22) Filed: Dec. 18, 1998

(30) Foreign Application Priority Data

Dec. 19, 1997 (FR) ..... 97 16172

(51) Int. Cl.[7] ..... B65D 25/00
(52) U.S. Cl. ..... 220/695; 220/697
(58) Field of Search ..... 220/695, 697, 220/574.1, 324

(56) References Cited

U.S. PATENT DOCUMENTS

| | | | | |
|---|---|---|---|---|
| 348,160 | * | 8/1886 | Goldsmith | 220/695 X |
| 457,120 | * | 8/1891 | Ketchum | 220/697 X |
| 558,607 | * | 4/1896 | Hollen | 220/697 X |
| 571,438 | * | 11/1896 | Harlow | 220/697 X |
| 582,576 | * | 5/1897 | Bricker | 220/697 X |
| 583,152 | * | 5/1897 | McCollam | 220/697 X |
| 1,432,252 | * | 10/1922 | Leicht | 220/695 X |
| 3,298,561 | | 1/1967 | McConnie . | |
| 3,786,982 | * | 1/1974 | Rakes et al. | 220/324 X |
| 5,551,454 | | 9/1996 | Goncalves . | |

FOREIGN PATENT DOCUMENTS

| | | |
|---|---|---|
| 2239235 | 12/1998 | (CA) . |
| 3 149 303 | 6/1983 | (DE) . |
| 91 14 965 | 4/1992 | (DE) . |
| 0 884 008 A1 | 12/1998 | (EP) . |
| 1 043 614 | 11/1953 | (FR) . |
| WO 97/09904 | 3/1997 | (WO) . |

* cited by examiner

*Primary Examiner*—Steven Pollard
(74) *Attorney, Agent, or Firm*—Finnegan, Henderson, Farabow, Garrett & Dunner, L.L.P.

(57) ABSTRACT

A container includes a body having at least one wall defining an open area for containing fluid and a member. The body includes a guiding portion for guiding removal of an applicator from the container along a predetermined path and an opening permitting access to the open area of the body. The member includes a wiping portion having an open end. The wiping portion is shaped so that as the applicator is removed from the container along the predetermined path the wiping portion wipes at least two opposed points on a transverse section of the applicator. Also disclosed are systems and methods for dispensing fluid from the container.

42 Claims, 3 Drawing Sheets

CONTAINER, SYSTEM, AND METHOD FOR DISPENSING FLUID

Under the provisions of 35 U.S.C. § 119, this application claims priority of French Application No. 9716172, filed on Dec. 19, 1997, the entire disclosure of which is incorporated herein by reference.

The present invention relates to a container for containing and dispensing fluids. More particularly, the present invention relates to a container that contains and dispenses relatively viscous fluids to an applicator for application to the body. The present invention also relates to a system and a method for dispensing fluids from a container.

Containers are known in the art for containing and mixing fluids of relatively high viscosity, and for dispensing such fluids with an applicator. In particular, containers for mixing and dispensing multiple-component fluids are known. For example, hair dyes comprising an oxidizing agent and a cream dye are commonly mixed and dispensed from containers.

When applying fluids to certain areas of the body, e.g., the hair, consumers need a container that is capable of providing a uniform coating of fluid to an applicator. However, prior attempts to design containers have fallen short of meeting this need. Namely, known containers often do not reliably dispense a uniform coating of fluid to an applicator.

Some prior containers provide for removal of excess fluid from the applicator using the "free-hand" method. Namely, the user wipes the applicator across an edge of the container, guiding the path of the applicator using only his or her hand. Though the "free-hand" method does remove excess fluid from the applicator, it suffers from several drawbacks. Most importantly, wiping the applicator across the edge of the container without a guide produces variable coating of the applicator each time fluid is dispensed from the container. As stated above, a container that produces non-uniform coating of the applicator is unacceptable for many applications, particularly for applying hair dye.

Moreover, for applicators having more than one applicating side, the "free-hand" method requires the user to pass each applicating side of the applicator across the edge of the container. Executing multiple passes of the applicator across the wiping edge of the container can be time consuming and tedious for a user. In sum, the problems associated with the "free hand" method have generated consumer dissatisfaction with prior containers.

By way of example, containers having some of these drawbacks are disclosed in U.S. Pat. No. 3,298,561 to McConnie and French Patent No. 1,043,614 to Lointier. The containers disclosed therein lack a guiding portion to guide the applicator as it contacts the wiping edge of the container and thus, produce non-uniform coating of the applicator. Additionally, for applicators having multiple applicating sides, the containers of both McConnie and Lointier require passing the applicator across the wiping edge of the container once for each applicating side. Further, with some of the embodiments described in these references, the wiping portion of the container undesirably inhibits the user's ability to bring the applicator into contact with the fluid in the container.

In light of the foregoing, there is a need in the art for an improved container for dispensing fluids.

Accordingly, the present invention is directed to a container that substantially obviates one or more of the shortcomings of the related art.

A preferred object of the invention is to provide a container, comprising a member having at least one edge, capable of quickly and uniformly wiping excess fluid from an applicator.

Another preferred object of the invention is to provide a container having a simple design, which is economical to produce.

Preferably, the container is simple and clean to use, has relatively low cost, and allows for maximum user comfort.

It should be understood that the invention could still be practiced without performing one or more of the preferred objects and/or advantages set forth above.

Still other objects will become apparent after reading the following description of the invention.

To achieve these and other advantages, and in accordance with the purpose of the invention, as embodied and broadly described herein, the invention includes a container, comprising a body having at least one wall defining an open area for containing fluid. The body has an opening for permitting access to the open area and includes a guiding portion for guiding removal of an applicator from the container along a predetermined path. The container also includes a member having at least one edge. At least part of the at least one edge forms a wiping portion having an open end. The wiping portion is shaped so that as the applicator is removed from the container along the predetermined path, the wiping portion wipes at least two opposed points on a transverse section of the applicator.

In another aspect, the container includes a member above at least a portion of the open area. The member includes a slot having opposed sides spaced from one another for wiping excess fluid from at least two opposed points on a transverse section of the applicator as the applicator is removed from the open area of the body via the slot. The slot is positioned adjacent to the guiding portion of the body so that an applicating surface of the applicator contacts a guiding surface of the guiding portion during removal of the applicator. The guiding surface guides the applicator through the slot and wipes excess fluid from the applicating surface of the applicator.

In another aspect, the container includes a member pivotally connected to the body. The pivotal connection is configured so that the member may be selectively pivoted between a first position, covering at least a portion of the open area of the body and a second position, in which the member is located away from the open area of the body.

In still another aspect, the container includes a releasable fastener for releasably fastening the member in the first position. The releasable fastener includes at least one knob extending from the at least one wall and at least one opening in the member. In the alternative, the releasable fastener includes at least one knob extending from the member and at least one opening on the at least one wall. Under either configuration, the member is fastened by releasably engaging the at least one knob in the at least one opening.

In another aspect, the container and member are constructed of a single piece of thermoformed thermoplastic material. The thickness of the single piece of material between the member and the body is reduced to form a hinge to allow the member to be selectively pivoted between a first position, covering at least a portion of the open area of the body, and a second position, in which the member is located away from the open area of the body. Thermoforming technology is well known in the art and consists of softening a sheet of plastic using heat, deforming it against a mold, and cooling it in the mold until it becomes rigid. By way of example, the thermoplastic material may be chosen from polyethylenes, polypropylenes, polystyrenes, polyvinyl cholorides, polyethylene terephthalates, and polystyrenes.

In yet another aspect, the container includes a bottom wall and at least one side wall. The at least one side wall is inclined with respect to the bottom wall so that the inclined wall and a plane containing the bottom wall form an acute angle. In addition, an inner surface of the at least one side wall is the guiding surface of the guiding portion of the body. Further, the inclined wall extends from the bottom wall to a closed end of the wiping portion of the member.

In a further aspect, the angle between the inclined wall and the plane containing the bottom wall is from about 30° to about 60°. Preferably, the angle is about 45°.

Preferably, the distance from the intersection of the inclined wall and the bottom wall to the top of the inclined wall is at least as long as a diagonal of a lateral side of an applicating portion of the applicator. This configuration assures that the applicator is guided along its entire length through the wiping portion of the member so that the excess fluid is uniformly removed from the entire applicating portion of the applicator.

In still a further aspect, the container includes a member above at least a portion of the open area. The member includes at least one wiping edge for wiping sides of an applicator when the applicator is removed from the open area along the guiding portion of the body. Preferably, the member is pivotally connected to the body so that the member may be selectively pivoted between a first position covering at least a portion of the open area of the body and a second position in which the member is located away from the open area of the body.

In another aspect, the invention includes a system for dispensing fluid, comprising at least one of the containers discussed above and an applicator.

In still another aspect, the system includes an applicator having a first portion and a second portion, which are pivotally connected to one another. The first portion of the applicator includes an applicating portion, having at least two rows of teeth. The teeth are positioned on opposite sides of a longitudinal axis of the applicator. The free end of the teeth provide an applicating surface for the applicator. The second portion includes a shoulder for accommodating a lock of hair. The shoulder of the second portion fits between the at least two rows of teeth when the first and second portions are pivoted toward one another. Additionally, the second portion includes a projection and the first portion includes a recess. The projection is placed in the recess when the first and second portions are pivoted toward one another, thereby aligning the longitudinal axes of the first and second portions.

In a further aspect, the invention includes a method for dispensing fluid from a container with an applicator. The container includes a body having a guiding portion, an open area for containing fluid, and at least one wiping edge. The applicator includes an applicating portion. First, the applicator is inserted into the open area of the container to transfer fluid to the applicating portion of the applicator. Next, the applicator is removed from the open area of the container. While removing the applicator from the container, the excess fluid is wiped from the applicating portion by sliding the applicating portion along the guiding portion and sliding opposite sides of the applicating portion along the at least one wiping edge.

Preferably, the applicator is wiped on the member over the opening of the container to avoid soiling the edges of the container with fluid. Each time the applicator is passed open end of the wiping portion, the applicator follows a predetermined path to obtain a uniform and reproducible coating of fluid on the applicator. Even though an applicator may have multiple applicating sides, the wiping portion of the member removes the excess fluid from the applicator with a single pass.

Preferably, when mixing a fluid that includes two or more components, the member can be pivoted to a second position, in which the member is located away from the open area of the body so that the member does not hinder the mixing of the fluid. After the mixing, the member can be selectively pivoted back to a first position, covering at least a portion of the open area of the body.

Preferably, the applicator includes a rigid or semi-rigid applicating portion. In particular, the applicating portion may include bristles or teeth. In accordance with the present invention, the guiding portion of the body makes it possible to prevent fluid from being splashed out of the container when the applicator is removed from the container. Without such structure, splashing of fluid is possible.

Preferably, the wiping portion of the member is substantially U-shaped. However, this shape is given merely by way of example and is dependent on the type and shape of the applicator.

Preferably, the applicator may include of a brush, a comb or a paintbrush. The applicator may also include a hybrid arrangement of bristles and teeth.

Preferably, the fluid is applied to the hair. For example, the fluid may include a hair dye.

Besides the structural arrangements and method steps set forth above, the invention could include a number of other arrangements and method steps, such as those explained hereinafter. It should be understood that both the foregoing general description and the following detailed description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1A is a view showing an embodiment of an applicator with a first portion and a second portion pivoted toward one another;

Figure 1A:
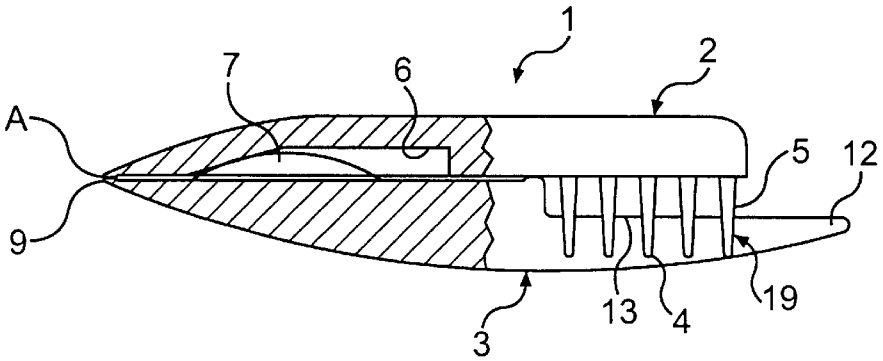
FIG. 1B is a view showing the applicator of FIG. 1A with the first portion and the second portion pivoted away from one another.
FIG. 1C is a top view of the applicator of FIG. 1B.

Reference will now be made in detail to the present preferred embodiments of the invention, examples of which are illustrated in the accompanying drawings. Wherever possible, the same reference numbers are used in the drawings and the description to refer to the same or like parts having similar structural configuration(s) and or function(s).

Figure 1B:
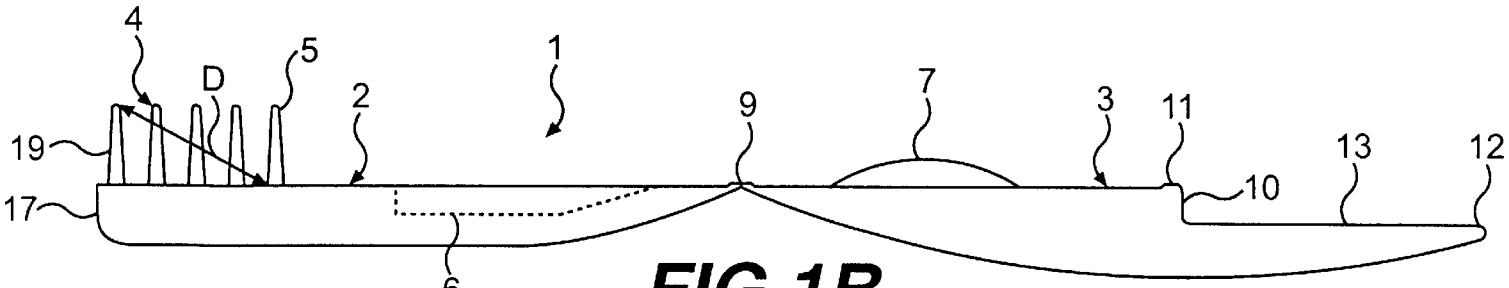
Figure 1C:
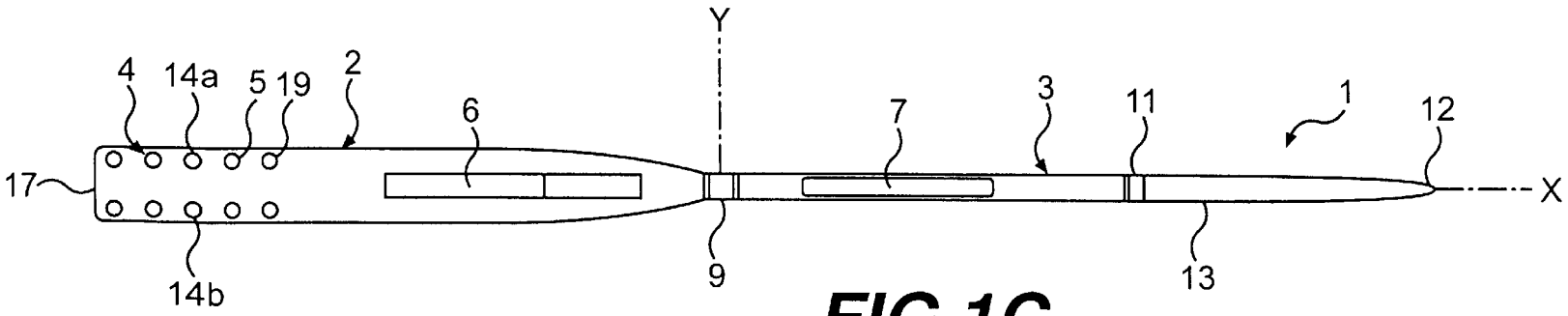
Figure 2:
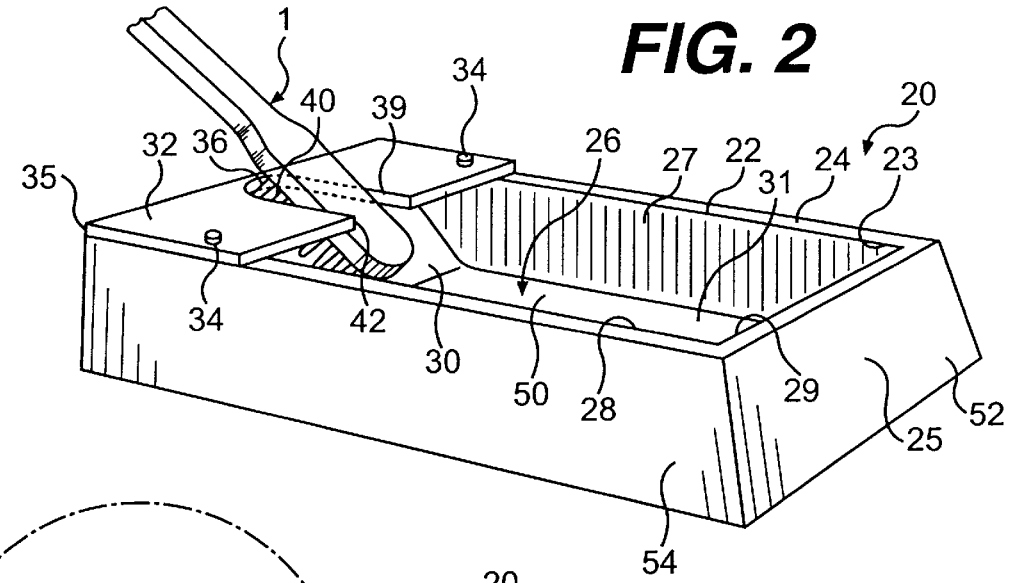
FIG. 2 is a perspective view of an embodiment of a container and a portion of an applicator like that of FIGS. 1A–1C.

FIGS. 1A–1C show an embodiment of an applicator 1, which can be used in conjunction with a container 20, shown in FIG. 2 and described infra. However, it should be understood that the container 20 can be used with other types of applicators as well, for example, a brush, a comb, etc.

Preferably, the applicator 1 is made up of a first portion 2 and a second portion 3. The first portion 2 and the second portion 3 are pivotally connected to one another at pivot-point 9. The first and second portions 2, 3 are capable of pivoting relative to one another about an axis Y shown in FIG. 1C, perpendicular to a longitudinal axis X of the first and second portions 2, 3. In particular, the portions 2, 3 may be pivoted in a first direction toward one another so that ends 12, 17 of portions 2, 3 approach one another and in a second direction away from one another so that ends 12, 17 are remote from one another.

Preferably, the applicator 1 has an applicating portion 19, located near the end 17 of the first portion 2. The applicating portion 19 preferably includes at least two rows of teeth 5, positioned on opposite sides of the longitudinal axis X of the applicator 1. In one embodiment, the teeth 5 are from about 5 mm to about 20 mm long. Preferably, the teeth 5 are from about 10 mm to about 15 mm long. The applicating portion 19 has two lateral applicating sides 14*a*, 14*b* shown in FIG. 1C and an applicating surface 4 shown in FIGS. 1A and 1B, defined by the free end of the teeth 5. A transverse section of the applicator 1 is defined as a cross-section of the applicator 1 in a plane parallel to the axis Y shown in FIG. 1C.

Preferably, the first portion 2 includes a recess 6 between the applicating portion 19 and the pivot-point 9. The second portion 3 includes a projection 7, which is placed in the recess 6 when the first and second portions 2, 3 are pivoted toward one another as shown in FIG. 1A. When the projection 7 is placed in the recess 6, the first and second portions 2, 3 are aligned along the longitudinal axis X. Preferably, the projection 7 has a convex profile.

In a preferred embodiment, the second portion 3 includes a shoulder 13 for accommodating a lock of hair. Preferably, the width of the shoulder 13 is slightly smaller than the spacing between the two rows of teeth 5, allowing the shoulder 13 to fit between the two rows of teeth 5. By placing a lock of hair in the shoulder 13 and pivoting the first and second portions 2, 3 toward one another, the lock of hair can be secured in the applicator 1 between the teeth 5 and the shoulder 13.

Preferably, the shoulder 13 has a neck portion 10 for preventing hair from sliding into the pivotal connection between the first and second portions 2, 3. The neck 10 also forms a stop 11 for maintaining a minimum distance between the shoulder 13 and the bottom ends of the teeth 5. Preferably, the stop 11 is configured to allow the shoulder 13 to extend to a depth of no more than from about 5 mm to about 10 mm below the free surface of the teeth 5 when the first and second portions 2, 3 are fully pivoted toward one another. This configuration assures a clearance between the bottom of the teeth 5 and the shoulder 13 of about 5 mm to about 7 mm so that the applicating portion 19 can be slid along a lock of hair when the lock is placed between the teeth 5 and the shoulder 13 of the applicator 1.

Preferably, the longitudinal length of the second portion 3 is longer than the longitudinal length of first portion 2 so that the end 12 of the second portion 3 can be used to pick up a lock of hair and position the lock with respect to the applicating portion 19 and the shoulder 13.

Figure 3A:
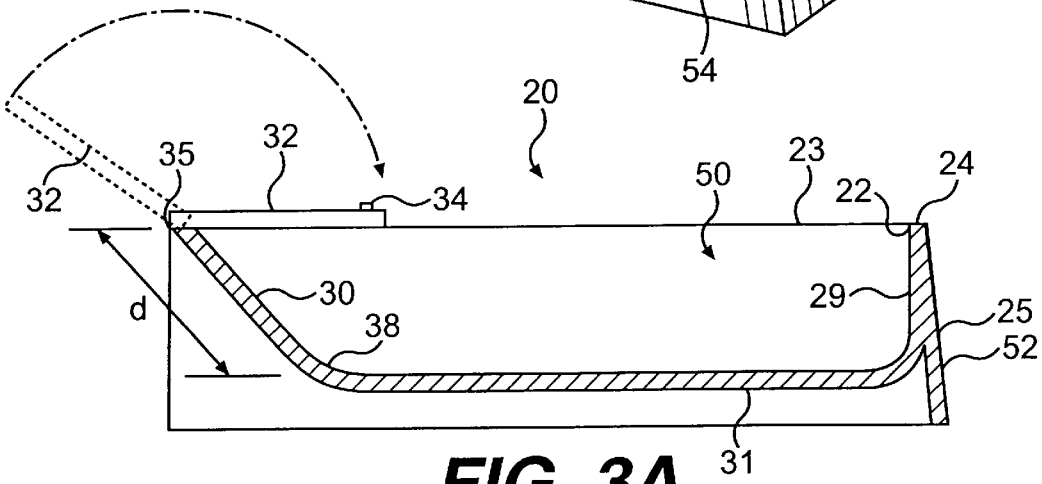
FIG. 3A is a partial cross-sectional side view of the container of FIG. 2.
Figure 3B:
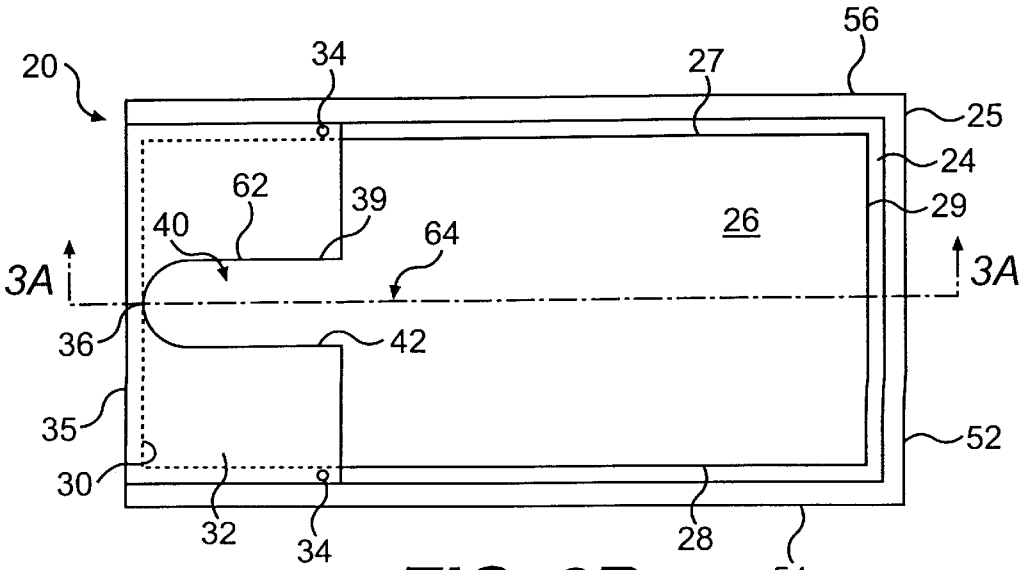
FIG. 3B is a top view of the container of FIG. 2.

FIGS. 2, 3A, and 3B show an embodiment of the container 20. The container 20 includes a body 26 and a member 32. Preferably, the body 26 is a thermoformed piece of thermoplastic. The body 26 has an upper edge 22, which defines an opening 23 leading to an open area 50. The open area 50 of the container 20 is capable of containing a fluid. A rim 24 is provided adjacent to the upper edge 22, surrounding the opening 23.

The body 26 includes two internal lateral walls 27, 28, two internal end walls 29, 30, and a bottom wall 31. An outer wall 25 extends downward from the rim 24 adjacent to the lateral walls 27, 28 and the end wall 29, forming three outer faces 52, 54, and 56. The three outer faces 52, 54, and 56 of the outer wall 25 form a base to support the container 20. Preferably, the lateral walls 27, 28 and the end wall 29 are substantially perpendicular to the bottom wall 31 and are joined to the bottom wall 31 by filleted joints.

Preferably, the end wall 30 is inclined at an acute angle with respect to a plane containing the bottom wall 31, and is joined to the bottom wall 31 at a joint 38 having a large radius. The acute angle between the end wall 30 and the plane containing the bottom wall 31 is preferably between about 30° and about 60°. In a preferred embodiment, the angle is about 45°. An interior surface of the inclined end wall 30 provides a guiding portion for the application surface 4 of applicator 1. This guiding portion allows the applicator 1 to be removed from the container 20 along a predetermined path.

The member 32 is preferably connected to the top of the inclined end wall 30. Preferably, the member 32 and the body 26 are constructed of a single piece of thermoformed thermoplastic material. By way of example, the thermoplastic material could be chosen from polyethylenes, polypropylenes, polystyrenes, polyvinyl chlorides, polyethylene terephthalates, and polystyrenes. Referring to FIGS. 3A and 3B, the thickness of the material between the member 32 and the body 26 is reduced to form a hinge 35, allowing the member 32 to be selectively pivoted between a first position covering at least a portion of the open area 50 (as shown with solid lines in FIG. 3A) and a second position in which the member 32 is located away from the open area 50 of the body 26 (as shown with broken lines in FIG. 3A). In the second position, the free edge of the member 32 is substantially aligned with the end of the inclined end wall 30 in the plane of the opening 23.

Although the member 32 is a single piece of material in the preferred embodiment shown in the drawings, the member 32 could be formed of separate pieces of material.

Figure 3C:
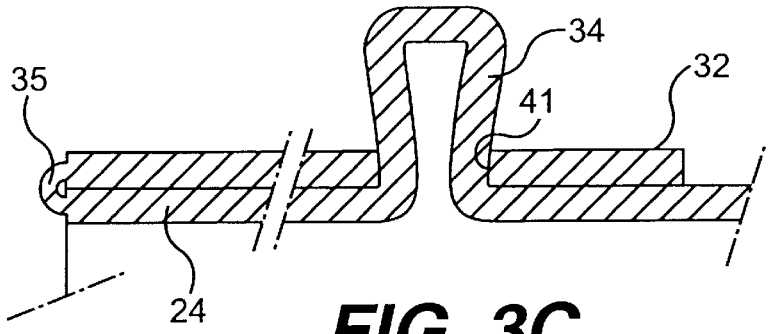
FIG. 3C is a cross-sectional view of a portion of the container of FIG. 2.

Referring to FIG. 3C, when the member 32 is pivoted to the first position, the member 32 can be releasably fastened to the rim 24 by clips or knobs 34 and openings 41. In particular, the knobs 34 releasably engage (i.e., snap fasten in) the openings 41 by elastically deforming the knobs 34 after the knobs 34 pass through the openings 41. Though the knobs 34 are shown on the rim 24 and the openings 41 are shown on the member 32, one of ordinary skill in the art will appreciate that the invention could be practiced with the knobs 34 on the member 32 and the openings 41 on the rim 24.

The member 32 includes at least one edge 62 and a part of the edge 62 forms a wiping portion (also referred to as a slot) 40. The wiping portion is dimensioned according to the size of the particular applicator used with the container. Preferably, the wiping portion 40 is substantially U-shaped, having opposed wiping sides 39, 42 for wiping the lateral sides 14*a*, 14*b* of the applicator 1. Alternatively, the wiping portion 40 could have a variety of different shapes and configurations, depending upon the particular shape of the applicator 1. The wiping portion 40 preferably has an open end 64 and a closed end 36. The closed end 36 is flush with the inclined end wall 30 when the member 32 is positioned as shown in FIGS. 2, 3A and 3B so that when the applicator 1 is guided along the inclined wall 30, the free ends of the teeth 5 do not significantly catch on the closed end 36 of the wiping portion 40. The open end 64 facilitates movement of the applicator 1 into the wiping portion 40 after the applicator 1 is initially placed in the container 20.

Referring to FIGS. 3A and 1 B, the distance d from the intersection of the inclined end wall 30 and the bottom wall 31 to the hinge 35 is preferable at least as long as a diagonal D of the lateral sides 14*a*, 14*b* of applicating portion 19. This configuration assures that the entire applicating portion of the applicator 1 is wiped by opposed wiping sides 39, 42 of the wiping portion 40. Although the applicator 1 shown in FIGS. 1A–1C is shaped slightly different from the applicator 1 shown in FIG. 2, these applicators function in substantially the same way.

Methods of dispensing fluid from a container are discussed below, with reference to the FIGS. 1A, 1B, 1C, 2, 3A, 3B, 3C, 4A and 4B. Although the invention is described in connection with the structure shown in these Figs. , it should be understood that the invention, in its broadest sense, is not so limited.

When the container 20 is used in combination with the applicator 1, initially, the member 32 is pivoted from a first position to a second position (as shown with broken lines in FIG. 3A) so that the member 32 is located away from the open area 50 of the container 20. Next, multiple components of a fluid 60 are added to the open area 50 of the container 20. After adding the components, the fluid 60 is mixed using the applicator 1, or another suitable tool, such as a spatula. Then, the member 32 is pivoted back to the first position so that the member 32 members at least a portion of the open area 50. Using the knobs 34 and the corresponding openings 41, the member 32 is releasably fastened to the rim 24 of the body 26.

Figure 4A:
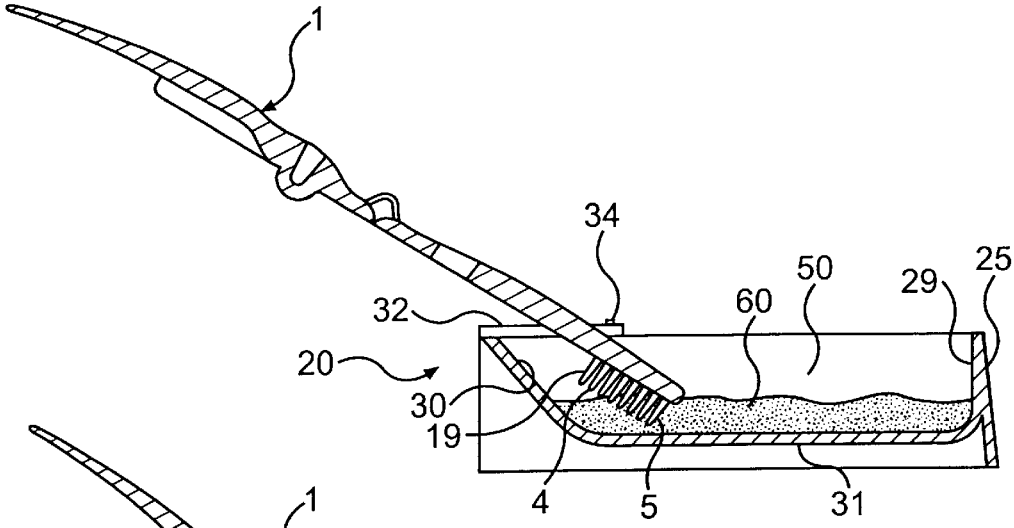
FIG. 4A is a view showing a container dispensing fluid to an applicator like that of FIGS. 1A–1C.
Figure 4B:
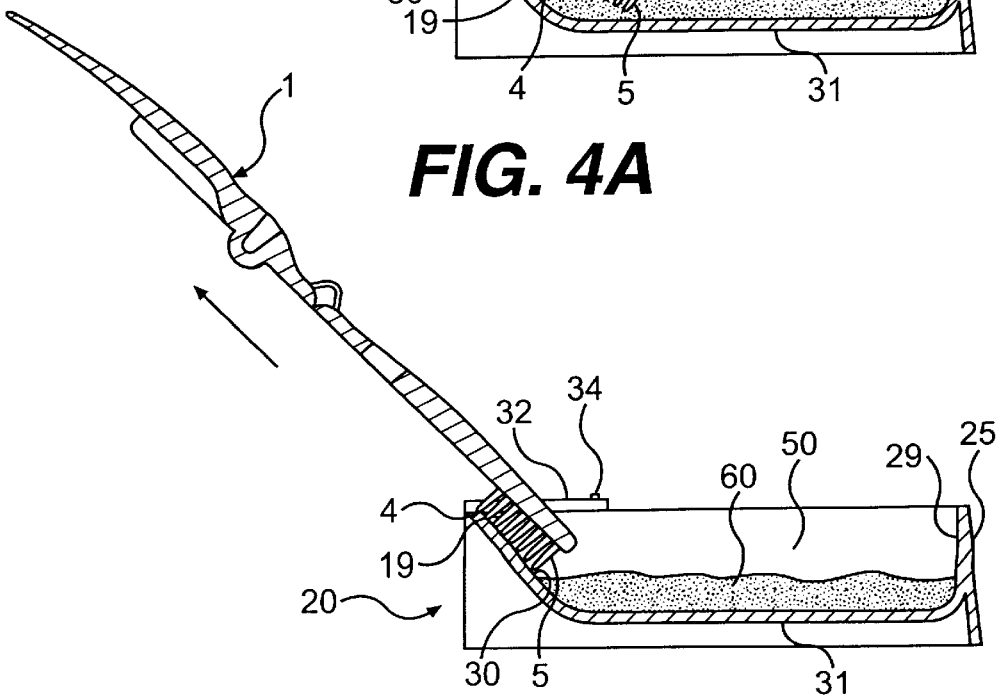
FIG. 4B is a view showing removal of excess fluid from the applicator.

After fastening the member 32 to the rim 24, the user dips the applicator 1 into the fluid 60 as shown in FIG. 4A, while the applicator 1 is in the open position. If necessary, the user positions the applicating portion 19 of the applicator 1 so that the applicating surface 4 of the applicating portion 19 is facing toward the inner surface of the inclined end wall 30. The user then places the applicator 1 between the opposed wiping sides 39, 42 of the wiping portion 40. After properly positioning the applicator 1, the user slides the applicating portion 19 of the applicator 1 along the inclined end wall 30 and through the wiping portion 40 as shown in FIG. 4B. As the applicating portion 19 passes along the inclined end wall 30 and through the wiping portion 40, the opposed wiping sides 39, 42 of the wiping portion 40 remove excess fluid from the lateral sides 14*a*, 14*b* (shown in FIG. 1C) of the applicating portion 19. Preferably, the wiping portion 40 wipes at least two opposed points on a transverse section of the applicator 1. In addition, the inclined end wall 30 preferably removes excess fluid from the applicating surface 4 of the applicating portion 19.

By sliding the applicator 1 along the inclined end wall 30, the applicator is guided through the wiping portion 40 along a consistent path to systematically remove the excess fluid. Wiping the applicator 1 along a consistent path preferably assures uniform coating of the applicator 1 each time the applicator 1 is removed from the container 20 (assuming that open area 50 contains a sufficient amount of the fluid 60). After removing the applicator 1 from the container 20, the excess fluid wiped from the applicator 1 drips back into the open area 50 from the opposed wiping sides 39, 42 and the inclined end wall 30. Preferably, the excess fluid does not soil outer edges of the container 20.

After dispensing the proper amount of fluid 60 from the container 20 to the applicator 1, the user next selects a lock of hair that he or she would like to treat. Using the end 12 of the second portion 3 like the tail of a comb, the user can select a particular lock with a great deal of precision. Having selected a particular lock, the user places the lock in the shoulder 13 of the second portion 3. The neck 10 of the second portion 3 prevents the lock selected from sliding into the pivotal connection between portions 2, 3.

Next, the user pivots the first and second portions 2, 3 toward one another to close the applicator 1 as shown in FIG. 1A. As the applicator 1 is closed, the projection 7 enters the recess 6 to align the longitudinal axes of the first and second portions 2, 3 of the applicator 1. In the closed position, the two rows of teeth 5 are positioned on alternate sides of the shoulder 13 and the fluid is in contact with the lock. To complete the application, while the applicator 1 in the closed position, the user slides the applicator 1 towards the end of the lock so that the lock is uniformly coated with fluid from the root to the end. This process is repeated as many times as desired.

In the figures, the member 32 is shown located at one end of the container. However, in an alternate embodiment, the member is arranged on one of the lateral walls 27, 28 of the container 20, which is inclined similar to the end wall 30. In this configuration, the container 20 preferably does not have an outer wall 25 so that the applicator 1 can pass under the inclined lateral wall.

It will be apparent to those skilled in the art that various modifications and variations can be made to the structure and methodology of the present invention without departing from the scope or spirit of the invention. In view of the foregoing, it is intended that the present invention cover modifications and variations of this invention provided they fall within the scope of the following claims and their equivalents.

What is claimed is:

1. A container comprising:

a body having at least one wall defining an open area for containing fluid and an opening for permitting access to the open area, the body including a guiding portion for guiding removal of an applicator from the container along a predetermined path; and a member having at least one edge, wherein at least part of the at least one edge forms a wiping portion having an open end, the wiping portion being shaped so that as the applicator is removed from the container along the predetermined path, the wiping portion wipes at least two opposed points on a transverse section of the applicator.

2. The container of claim 1, wherein a portion of the member is releasably attachable to the body.

3. The container of claim 1, wherein the member is pivotally connected to the body so that the member may be selectively pivoted between a first position covering at least a portion of the open area of the body and a second position in which the member is located away from the open area of the body.

4. The container of claim 3, further comprising a releasable fastener for releasably fastening the member in the first position.

5. The container of claim 4, wherein the releasable fastener includes at least one knob extending from the at least one wall and at least one opening in the member, wherein the at least one knob is releasably engaged in the at least one opening to fasten the member releasably in the first position.

6. The container of claim 4, wherein the releasable fastener includes at least one knob extending from the member and at least one opening in the at least one wall, wherein the at least one knob is releasably engaged in the at least one opening to fasten the member releasably in the first position.

7. The container of claim 1, wherein the member is attached to the body at a location on the at least one wall adjacent to the opening.

8. The container of claim 1, wherein the body and the member are constructed of a single piece of material.

9. The container of claim 8, wherein the single piece of material is thermoformed thermoplastic material.

10. The container of claim 9, wherein the thermoplastic material is chosen from polyethylenes, polypropylenes, polystyrenes, polyvinyl chlorides, polyethylene terephthalates, and polystyrenes.

11. The container of claim 8, wherein the thickness of the material between the member and the body is reduced to form a hinge to allow the member to be selectively pivoted between a first position covering at least a portion of the open area of the body and a second position in which the member is located away from the open area of the body.

12. The container of claim 1, wherein the wiping portion is positioned adjacent to the guiding portion so that an applicating surface of the applicator contacts a guiding surface of the guiding portion during removal of the applicator along the predetermined path.

13. The container of claim 1, wherein the guiding portion of the body is a surface of an inclined wall of the body.

14. The container of claim 1, wherein the body includes a bottom wall and at least one side wall.

15. The container of claim 14, wherein the at least one side wall is inclined with respect to the bottom wall so that the at least one side wall and a plane containing the bottom wall form an acute angle, an inner surface of the at least one side wall being the guiding portion of the body and the at least one side wall extending from the bottom wall to a closed end of the wiping portion.

16. The container of claim 15, wherein the acute angle is from about 30° to about 60°.

17. The container of claim 15, wherein the acute angle is about 45°.

18. The container of claim 15, wherein the distance from the intersection of the at least one side wall and the bottom wall to a top of the at least one side wall is at least as long as a diagonal of a lateral side of an applicating portion of the applicator.

19. The container of claim 1, wherein the wiping portion is a slot having an open end.

20. The container of claim 19, wherein the slot is substantially U-shaped.

21. A system for dispensing fluid, comprising: the container of claim 1 and an applicator.

22. The system of claim 21, wherein the applicator includes at least one of a brush and a comb.

23. The system of claim 21, wherein the applicator comprises a first portion and a second portion, wherein the first portion and the second portion are pivotally connected to one another.

24. The system of claim 23, wherein the first portion includes an applicating portion located adjacent to an end of the applicator located away from the pivotal connection.

25. The system of claim 24, wherein the second portion includes a shoulder for placing hair in a region of the applicating portion when the first and second portions are pivoted toward one another.

26. The system of claim 25, wherein the second portion has a notch located adjacent to an end of the applicator located away from the pivotal connection.

27. The system of claim 24, wherein the applicating portion includes at least two rows of teeth, the rows being positioned on opposite sides of a longitudinal axis of the applicator and a free end of the teeth providing an applicating surface of the applicator.

28. The system of claim 27, wherein the second portion fits between the at least two rows of teeth when the first and second portions are pivoted toward one another.

29. The system of claim 23, wherein the second portion includes a projection and the first portion includes a recess, the projection being placed in the recess when the first and second portions are pivoted toward one another, thereby aligning longitudinal axes of the first and second portions.

30. The system of claim 29, wherein the projection has a convex profile.

31. The system of claim 21, wherein the system further includes fluid in the open area of the container.

32. The system of claim 31, wherein the fluid is a hair dye.

33. A method for dispensing fluid from a container with an applicator, the container including a body including a guiding portion, an open area containing fluid, and at least one wiping edge, the applicator including an applicating portion, comprising:

inserting the applicator into the open area of the container to transfer fluid to the applicating portion of the applicator;

removing the applicator from the open area of the container; and wiping excess fluid from the applicating portion by sliding the applicating portion along the guiding portion and sliding opposite sides of the applicating portion along the wiping edge.

34. The method of claim 33, wherein the method further includes adding at least two fluid components to the open area of the container and mixing the at least two fluid components.

35. The method of claim 33, wherein the method further includes applying fluid from the applicating portion to a desired location of a body.

36. The method of claim 33, wherein the container includes a member having a wiping portion having an open end, wherein the guiding portion is an inner surface of an inclined wall of the container, and wherein the wiping of the excess fluid further comprises sliding the applicating portion along the inner surface of the inclined wall so that the wiping portion wipes at least two opposed points on a transverse section of the applicator.

37. The method of claim 33, wherein the fluid is hair dye, and wherein the method further includes applying the hair dye to hair.

38. The method of claim 33, wherein the container includes a pivotal member, and wherein the method further comprises filling the open area with the fluid when the member is in a first position away from the open area and pivoting the member to a second position covering at least a portion of the open area.

39. The method of claim 38, wherein the method further comprises fastening the member in the second position.

40. A container comprising:

a body having at least one wall defining an open area for containing fluid and an opening for permitting access to the open area, the body including a guiding portion; and a member above at least a portion of the open area, the member including at least one wiping edge forming a wiping portion having an open end, the wiping portion wiping sides of an applicator when the applicator is removed from the open area along the guiding portion of the body, wherein the member is pivotally connected to the body so that the member may be selectively pivoted between a first position covering at least a portion of the open area of the body and a second position in which the member is located away from the open area of the body.

41. The container of claim 39, wherein the member includes a slot having opposed wiping sides for wiping the applicator when the applicator is removed from the open area along the guiding portion of the body.

42. A container comprising:

a body having at least one wall defining an open area for containing fluid and an opening for permitting access to the open area, the body including a guiding portion; and a member above at least a portion of the open area, the member including a slot having an open end and opposed sides spaced from one another so that the sides of the slot wipe excess fluid from at least two opposed points on a transverse section of the applicator when the applicator is removed from the open area of the body via the slot, the slot being positioned adjacent to the guiding portion of the body so that an applicating surface of the applicator contacts a guiding surface of the guiding portion during removal of the applicator through the slot to guide the removal of the applicator and to wipe excess fluid from the applicating surface of the applicator.

* * * * *